US011825911B2

(12) United States Patent
Chen

(10) Patent No.: US 11,825,911 B2
(45) Date of Patent: Nov. 28, 2023

(54) FASTENING DEVICE

(71) Applicant: Chin-Chu Chen, Taichung (TW)

(72) Inventor: Chin-Chu Chen, Taichung (TW)

( * ) Notice: Subject to any disclaimer, the term of this patent is extended or adjusted under 35 U.S.C. 154(b) by 551 days.

(21) Appl. No.: 17/261,167

(22) PCT Filed: Jul. 8, 2019

(86) PCT No.: PCT/CN2019/095128
§ 371 (c)(1),
(2) Date: Jan. 18, 2021

(87) PCT Pub. No.: WO2020/087975
PCT Pub. Date: May 7, 2020

(65) Prior Publication Data

US 2021/0284483 A1 Sep. 16, 2021

(30) Foreign Application Priority Data

Oct. 30, 2018 (CN) ..... 201811275410.1

(51) Int. Cl.
*A43C 11/16* (2006.01)

(52) U.S. Cl.
CPC ..... *A43C 11/165* (2013.01); *B65H 2701/35* (2013.01)

(58) Field of Classification Search
CPC ..... A43C 11/165
See application file for complete search history.

(56) References Cited

U.S. PATENT DOCUMENTS

| | | | | |
|---|---|---|---|---|
| 7,475,842 | B2 | 1/2009 | Campbell | |
| 8,235,321 | B2 * | 8/2012 | Chen | A43C 11/008 242/378.1 |
| 8,245,371 | B2 | 8/2012 | Chen | |
| 8,308,098 | B2 * | 11/2012 | Chen | A43C 11/008 242/378.1 |
| 8,353,087 | B2 | 1/2013 | Chen | |
| 9,770,070 | B2 * | 9/2017 | Cotterman | A43C 11/20 |
| 2002/0152643 | A1 | 10/2002 | Kim | |
| 2006/0027696 | A1 | 2/2006 | Okabayashi | |

(Continued)

FOREIGN PATENT DOCUMENTS

| | | | |
|---|---|---|---|
| CN | 1074357 | A | 7/1993 |
| CN | 1618363 | A | 5/2005 |

(Continued)

*Primary Examiner* — Robert Sandy
(74) *Attorney, Agent, or Firm* — CKC & Partners Co., LLC

(57) ABSTRACT

A fastening device includes a case unit, a knob, an engaging unit and a spool. The case unit has an axial direction and includes a plurality of mounting teeth. The knob covers on the case unit along the axial direction. The engaging unit is coupled to the knob and includes an engaging portion. The spool is configured for a lace to wind therearound. The engaging unit is driven by the knob to switch between a first position and a second position along the axial direction. When the engaging unit is in the first position, the engaging unit prohibits the spool from releasing the lace. When the engaging unit is in the second position, the engaging portion is engaged with at least one of the mounting teeth, and the engaging unit does not prohibit the spool from releasing the lace. Therefore, the reliability can be improved.

12 Claims, 13 Drawing Sheets

(56) References Cited

U.S. PATENT DOCUMENTS

| | | | | |
|---|---|---|---|---|
| 2010/0116922 | A1 | 5/2010 | Choate et al. | |
| 2012/0228419 | A1* | 9/2012 | Chen | A43C 11/165 242/395 |
| 2016/0058130 | A1 | 3/2016 | Boney et al. | |
| 2017/0303643 | A1* | 10/2017 | Converse | A61F 5/0118 |
| 2021/0127794 | A1* | 5/2021 | Chen | A43C 11/06 |

FOREIGN PATENT DOCUMENTS

| | | | |
|---|---|---|---|
| CN | 101306676 | A | 11/2008 |
| CN | 101955090 | A | 1/2011 |
| CN | 102241347 | A | 11/2011 |
| CN | 103991345 | A | 8/2014 |
| CN | 205432385 | U | 8/2016 |
| CN | 205585439 | U | 9/2016 |
| CN | 106572723 | A | 4/2017 |
| CN | 206565397 | U | 10/2017 |
| DE | 202010010936 | U1 | 10/2010 |
| DE | 202011101828 | U1 | 8/2011 |
| EP | 2269479 | A1 | 1/2011 |
| EP | 2965647 | A1 | 1/2016 |
| JP | H07208 | A | 1/1995 |
| JP | 3159620 | U | 5/2010 |
| JP | 3202821 | U | 2/2016 |
| KR | 20160131296 | A | 11/2016 |
| KR | 101833680 | B1 | 2/2018 |
| WO | 2004110197 | A2 | 12/2004 |
| WO | 2007016983 | A1 | 2/2007 |
| WO | 2017175586 | A1 | 10/2017 |
| WO | 2018086068 | A1 | 5/2018 |
| WO | 2018143060 | A1 | 8/2018 |

* cited by examiner

FASTENING DEVICE

RELATED APPLICATIONS

This application is a continuation of International application No. PCT/CN2019/095128, filed Jul. 8, 2019, which claims the benefits of priority of China application No. 201811275410.1 filed on Oct. 30, 2018, the content of which are incorporated herein by reference.

BACKGROUND

Technical Field

The present disclosure relates to a fastening device. More particularly, the present disclosure relates to a fastening device for securing an article through loosening or tightening a lace.

Description of Related Art

In daily life, cords, such as a lace or a thread, are usually used to tighten articles. The most common tightening method is to use the cord to reciprocately pass through holes on the article, e.g., eyelets of a shoe, and then tie a knot to secure the article. But in this kind of tightening method, the knot is loosened easily owing to an external force. Not only does the knot need to be tied again, but also lots of inconveniences come owing to the insecurity of the articles.

In order to solve such problems, some practitioners developed a simple fastening mechanism including a case, an engaging unit and a spring. The case includes holes configured for the lace to pass therethrough. Through the reaction force between the spring and the engaging unit, the lace can be clamped between the engaging unit and the case so as to be fastened. The length of the lace can be changed by pressing the spring to change the position of the engaging unit. However, in such fastening mechanism, the restoring force of the spring is served as the securing force; thus, the lace is easily to be released owing to vibrations or an external force. In addition, the fastening mechanism has no space for receiving the lace, and the exposure of the lace may bring danger.

Therefore, some practitioners developed another kind of buckle which can be rotated to tighten the lace, and the lace can be received inside the buckle. Through the interference between components inside the buckle, the length of the lace as well as the tightness can be adjusted. However, the structure of the buckle is complex; as a result, the manufacturing cost is increased, and the buckle has assembly and repair difficulty.

Hence, the inner structure of the buckle is continuously improved by the practitioners, with a hope that the structure can be simplified while the securing capability thereof is remained, and the structure reliability thereof is increased to prevent shortenness of the life time.

Based on the above-mentioned problems, how to simplify the structure of the fastening device, reduce the manufacturing cost and maintain the securing capability becomes a pursuit target for practitioners.

SUMMARY

The present disclosure provides a fastening device, through the configuration of the engaging portion of the engaging unit, the structure reliability can be increased to prevent shortenness of the life time.

According to one embodiment of the present disclosure, a fastening device is provided, which includes a case unit, a knob, an engaging unit and a spool. The case unit has an axial direction and includes a plurality of mounting teeth. The knob covers on the case unit along the axial direction. The engaging unit is coupled to the knob and includes an engaging portion. The spool is configured for a lace to wind therearound. The engaging unit is driven by the knob to switch between a first position and a second position along the axial direction. When the engaging unit is in the first position, the engaging unit prohibits the spool from releasing the lace. When the engaging unit is in the second position, the engaging portion is engaged with at least one of the mounting teeth, and the engaging unit does not prohibit the spool from releasing the lace.

Therefore, when the engaging unit is in the second position, the engaging portion is engaged with at least one of the mounting teeth, and the structure relationship thereof is favorable for the engaging unit to switch successfully from the second position to the first position, thereby increasing the structure reliability.

According to one embodiment of the aforementioned fastening device, the engaging unit can further include a pawl arm selectively engaged with at least one of the mounting teeth, and the engaging portion can be located on the pawl arm and protrude outward along a radial direction of the case unit. The pawl arm can have a first height $H_1$, the engaging portion can have a second height $H_2$, and a relationship of $H_2 \leq (H_1/2)$ is satisfied. The pawl arm can have a height central line, and the engaging portion is lower than or flush with the height central line.

According to one embodiment of the aforementioned fastening device, the engaging unit can include an annular body, the pawl arm includes a proximal end and a distal end, and the proximal end is connected to the annular body. A first distance $D_1$ is contained between the proximal end and the distal end, a second distance $D_2$ is contained between the engaging portion and the proximal end, and a relationship of $D_2 \leq (2D_1/3)$ is satisfied. The first distance $D_1$ and the second distance $D_2$ can satisfy a relationship of $D_2=(D_1/2)$.

According to another embodiment of the present disclosure, a fastening device is provided, which includes a case unit, a knob, an engaging unit and a spool. The case unit has an axial direction. The knob covers on the case unit along the axial direction. The engaging unit is coupled to the knob and includes an engaging portion. The spool is configured for a lace to wind therearound. One of the knob and the case unit includes a plurality of mounting teeth. The engaging unit is driven by the knob to switch between a first position and a second position along the axial direction. When the engaging unit is in the first position, the engaging unit prohibits the spool from releasing the lace. When the engaging unit is in the second position, the engaging portion is engaged with at least one of the mounting teeth, and the engaging unit does not prohibit the spool from releasing the lace.

According to one embodiment of the aforementioned fastening device, the engaging unit can further include a pawl arm selectively engaged with at least one of the mounting teeth, and the engaging portion is located on the pawl arm and protrudes outward along a radial direction of the case unit. The pawl arm can have a first height $H_1$, the engaging portion can have a second height $H_2$, and the relationship of $H_2 \leq (H_1/2)$ is satisfied. The pawl arm can include a height central line, and the engaging portion is lower than or flush with the height central line.

According to one embodiment of the aforementioned fastening device, the engaging unit can include an annular body, the pawl arm includes a proximal end and a distal end, the proximal end is connected to the annular body, a first distance $D_1$ is contained between the proximal end and the distal end, a second distance $D_2$ is contained between the engaging portion and the proximal end, and the relationship of $D_2 \leq (2D_1/3)$ is satisfied. The first distance $D_1$ and the second distance $D_2$ can satisfy the relationship of $D_2=(D_1/2)$.

DETAILED DESCRIPTION

The embodiment will be described with the drawings. For clarity, some practical details will be described below. However, it should be noted that the present disclosure should not be limited by the practical details. That is, in some embodiment, the practical details are unnecessary. In addition, for simplifying the drawings, some conventional structures and elements will be simply illustrated, and repeated elements may be represented by the same labels.

In addition, it will be understood that when an element (or mechanism or module) is referred to as being "disposed on", "connected to" or "coupled to" another element, it can be directly disposed on, connected or coupled to the other one element, or it can be indirectly disposed on, connected or coupled to the other one element, that is, intervening elements may be present. In contrast, when an element is referred to as being "directly disposed on," "directly connected to" or "directly coupled to" another element, there are no intervening elements present. The terms first, second, third, etc. are used herein to describe various elements or components, these elements or components should not be limited by these terms. Consequently, a first element or component discussed below could be termed a second element or component.

Figure 1:
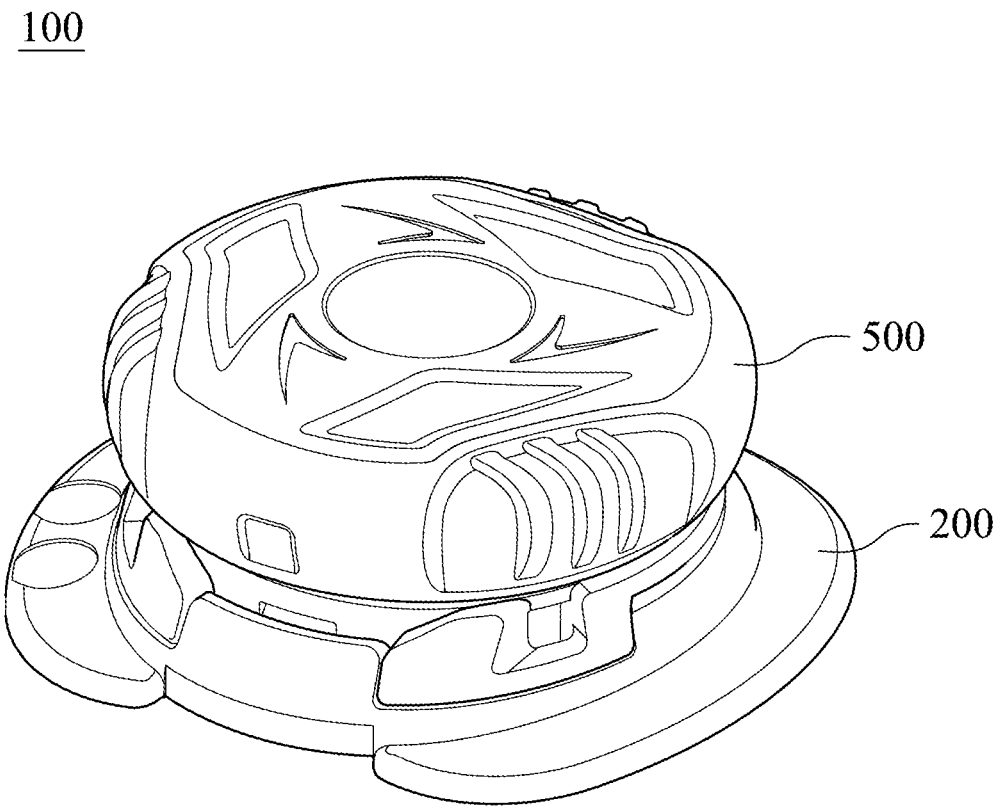
FIG. 1 shows a three dimensional schematic view of a fastening device according to one embodiment of the present disclosure.
Figure 2:
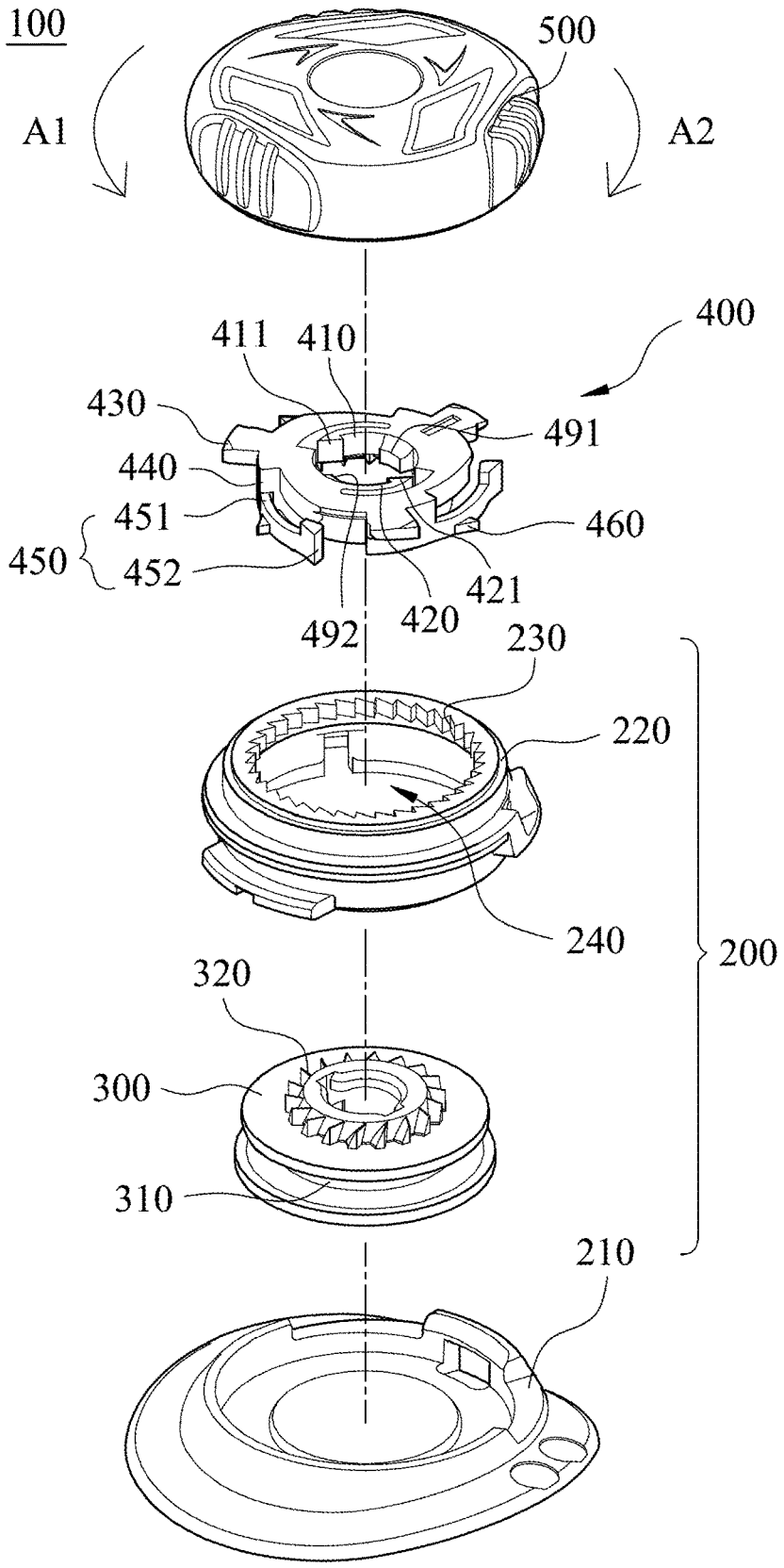
FIG. 2 shows one exploded view of the fastening device of FIG. 1.
Figure 3:
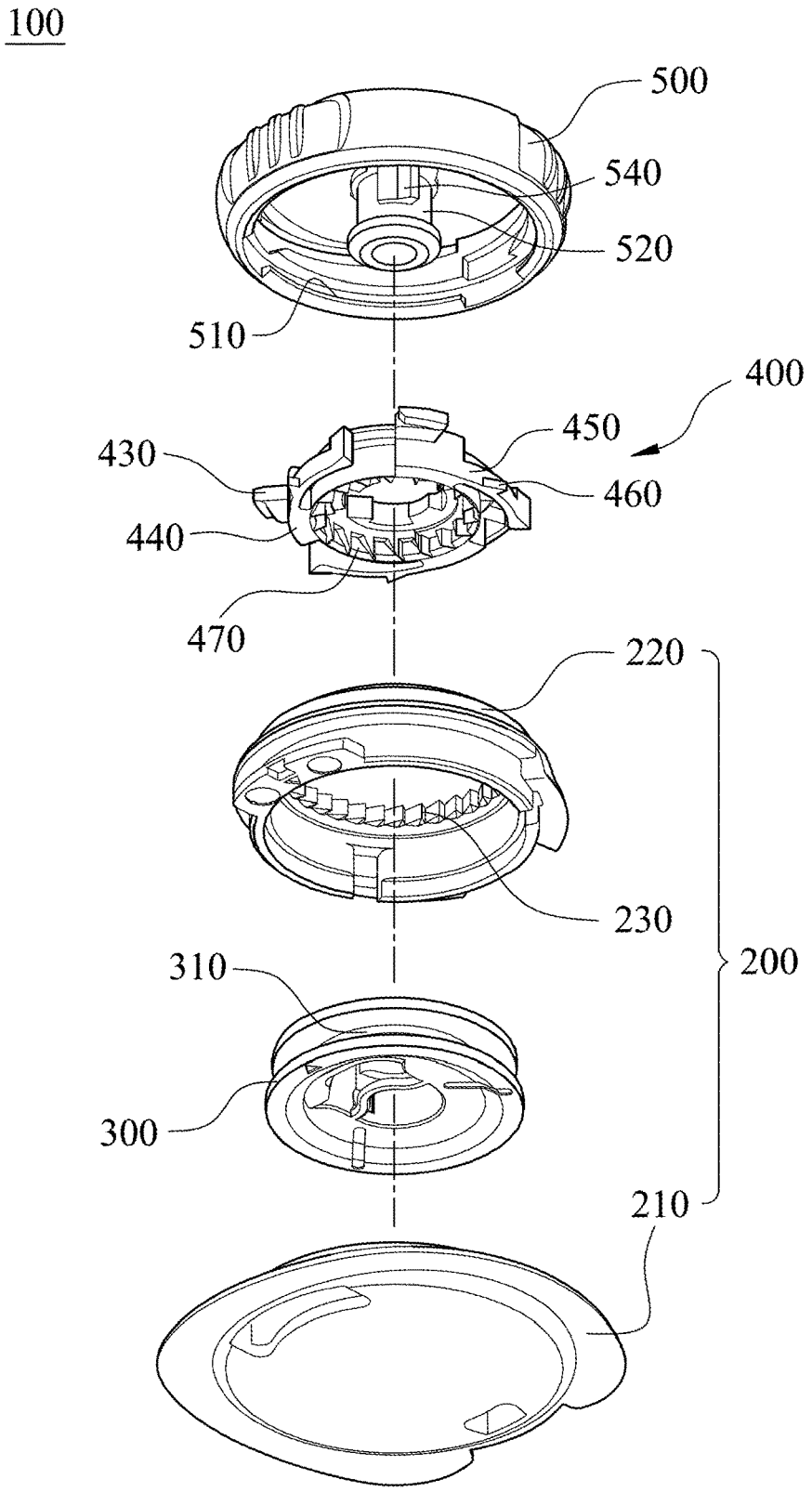
FIG. 3 shows another exploded view of the fastening device of FIG. 1.
Figure 4:
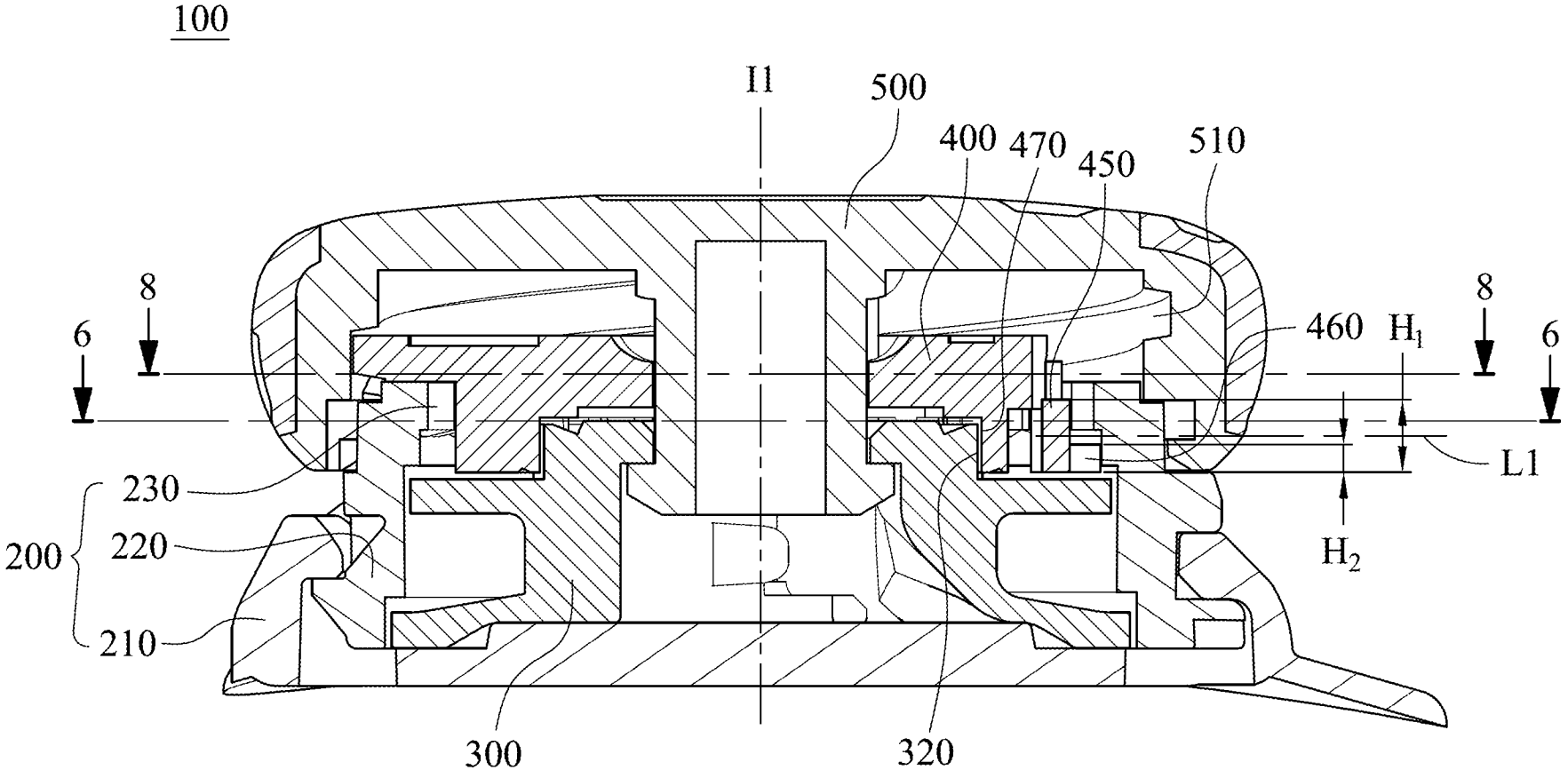
FIG. 4 shows one cross-sectional view of the fastening device of FIG. 1.
Figure 5:
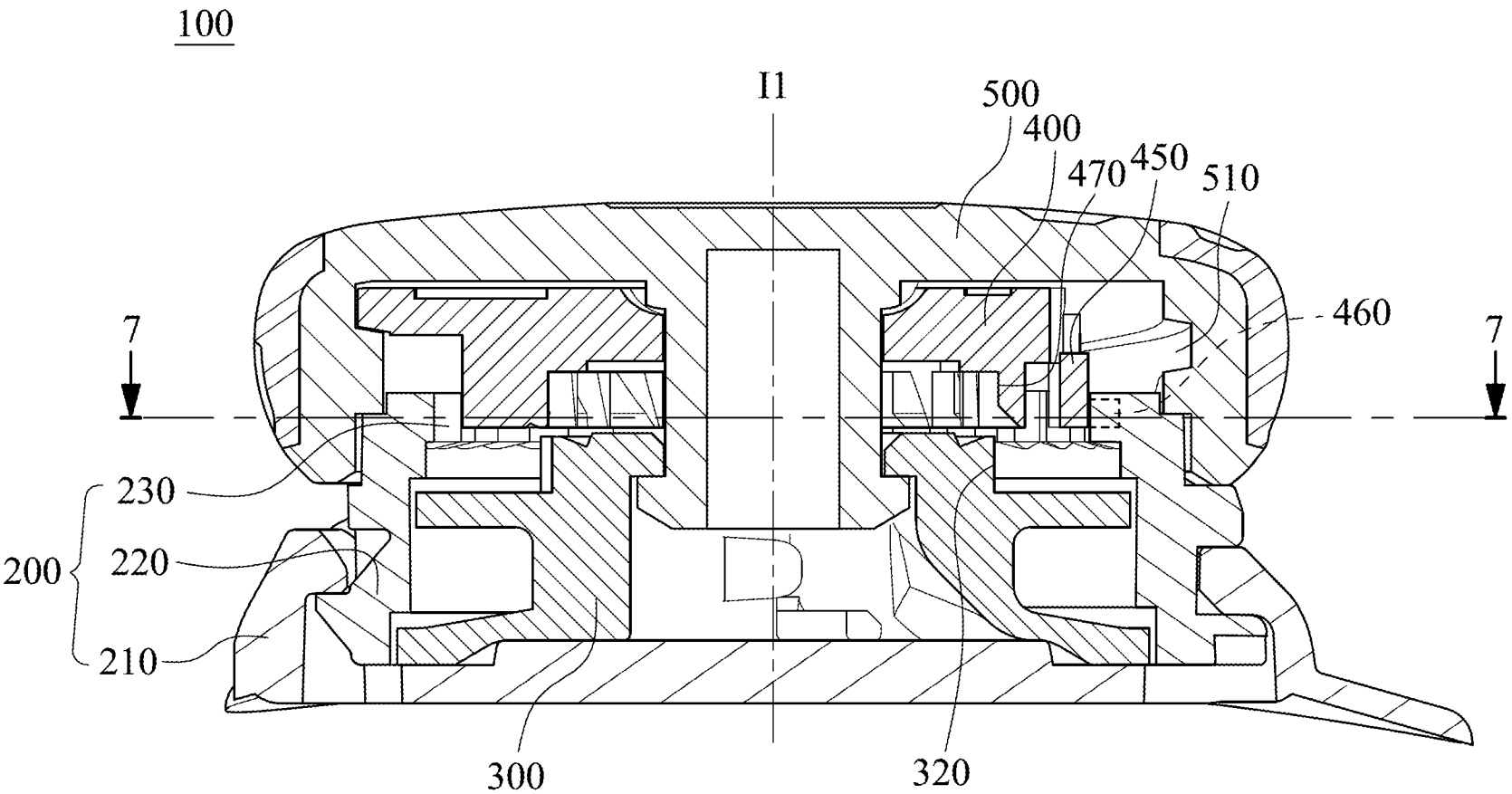
FIG. 5 shows another cross-sectional view of the fastening device of FIG. 1.
Figure 6:
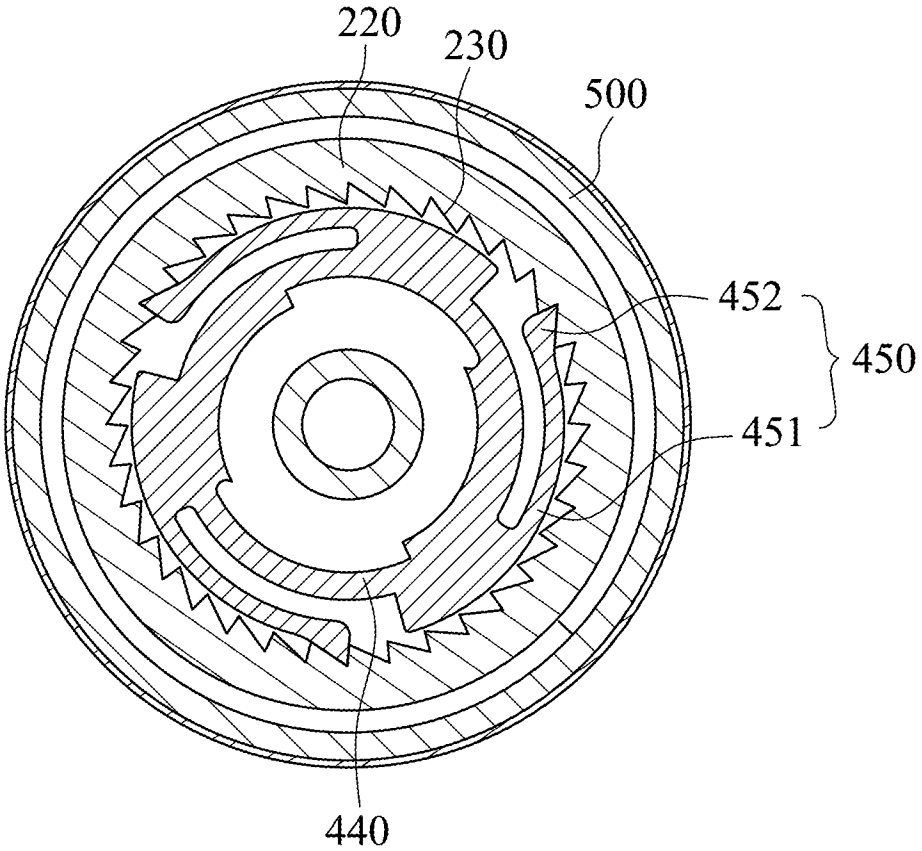
FIG. 6 shows one cross-sectional view of the fastening device of FIG. 4 taken along line 6-6.
Figure 7:
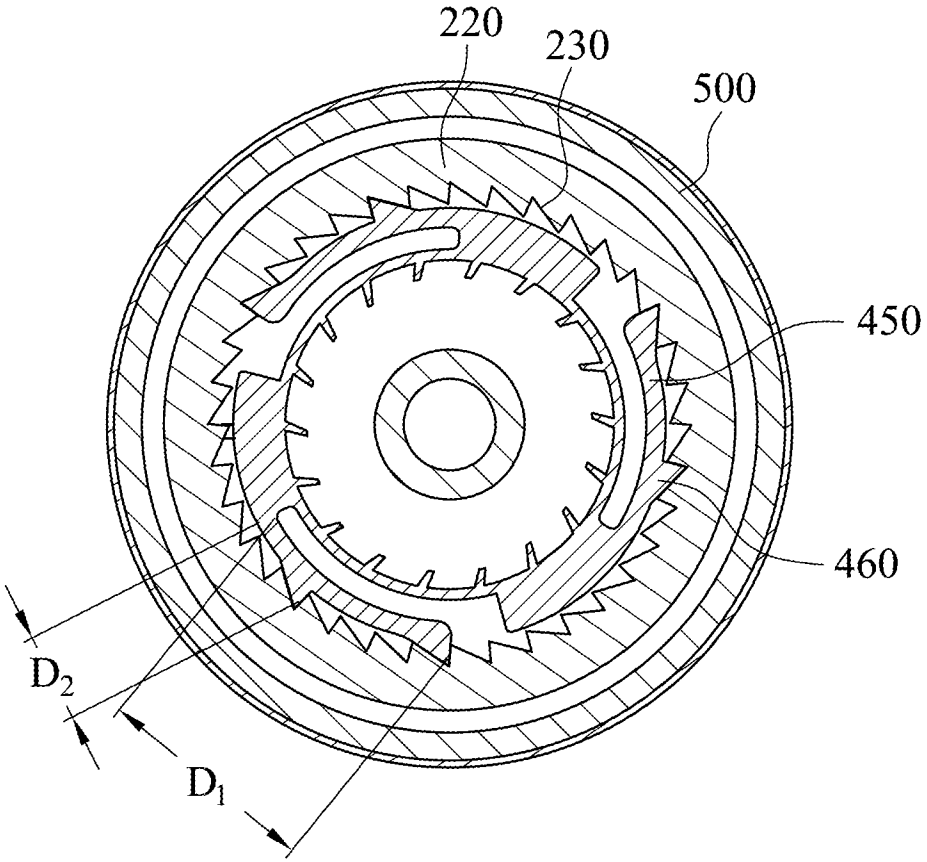
FIG. 7 shows one cross-sectional view of the fastening device of FIG. 5 taken along line 7-7.
Figure 8:
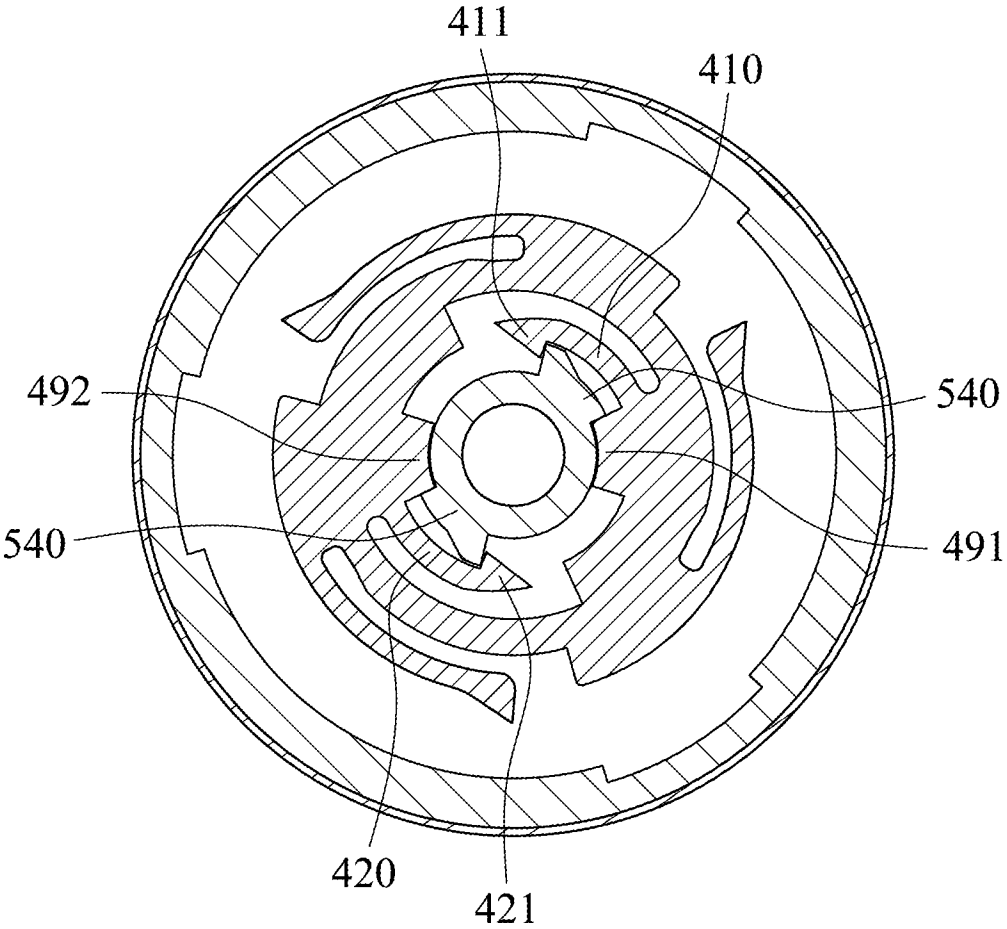
FIG. 8 shows one cross-sectional view of the fastening device of FIG. 4 taken along line 8-8.

Please refer to FIG. 1, FIG. 2, FIG. 3, FIG. 4, FIG. 5, FIG. 6, FIG. 7 and FIG. 8. FIG. 1 shows a three dimensional schematic view of a fastening device 100 according to one embodiment of the present disclosure. FIG. 2 shows one exploded view of the fastening device 100 of FIG. 1. FIG. 3 shows another exploded view of the fastening device 100 of FIG. 1. FIG. 4 shows one cross-sectional view of the fastening device 100 of FIG. 1. FIG. 5 shows another cross-sectional view of the fastening device 100 of FIG. 1. FIG. 6 shows one cross-sectional view of the fastening device 100 of FIG. 4 taken along line 6-6. FIG. 7 shows one cross-sectional view of the fastening device 100 of FIG. 5 taken along line 7-7. FIG. 8 shows one cross-sectional view of the fastening device 100 of FIG. 4 taken along line 8-8. The fastening device 100 includes a case unit 200, a knob 500, an engaging unit 400 and a spool 300.

The case unit 200 has an axial direction I1 and includes a plurality of mounting teeth 230. The knob 500 covers on the case unit 200 along the axial direction I1. The engaging unit 400 is coupled to the knob 500 and includes an engaging portion 460. The spool 300 is configured for a lace (not shown) to wind therearound. The engaging unit 400 is driven by the knob 500 to switch between a first position and a second position along the axial direction I1. When the engaging unit 400 is in the first position, the engaging unit 400 prohibits the spool 300 from releasing the lace, that is, prohibiting the spool 300 from rotating to a first direction A1. When the engaging unit 400 is in the second position, the engaging portion 460 is engaged with at least one of the mounting teeth 230, and the engaging unit 400 does not prohibit the spool 300 from releasing the lace, that is, not prohibiting the spool 300 from rotating to the first direction A1.

Hence, when the engaging unit 400 is in the second position, the engaging portion 460 is engaged with at least one of the mounting teeth 230, and the structure relationship thereof is favorable for the engaging unit 400 to switch from the second position to the first position successfully, thereby increasing the structural reliability. The detailed structure of the fastening device 100 will be described hereafter.

The case unit 200 has a radial direction, and the case unit 200 can further include an annular wall 220 and a base 210. The annular wall 220 surrounds an inner space 240. The base 210 is configured for the annular wall 220 to be disposed thereon, and the annular wall 220 can be disposed on the base 210 via means of engagement. The mounting teeth 230 are located on the annular wall 220 and face toward the inner space 240, and the mounting teeth 230 are located at an upper end of the annular wall 220.

The spool 300 is hollow ring-shaped. The spool 300 is located in the inner space 240 and includes an annular track 310 and a plurality of engaging teeth 320. The annular track 310 is configured for a lace to wind therearound, and the engaging teeth 320 are selectively coupled to the engaging unit 400. When the spool 300 is driven to rotate, the lace can be retracted or released as the spool 300 rotates in different directions.

The knob 500 includes a guiding track 510, a post 520, and two positioning blocks 540. The guiding track 510 is disposed on an inner wall of the knob 500. The post 520 protrudes toward the inner space 240 along the axial direction I1, and the two positioning blocks 540 are symmetrically disposed on an outside of the post 520 along the radial direction.

The engaging unit 400 includes an annular body 440, two retaining portions 410, 420, three guiding portions 430, three pawl arms 450, three engaging portions 460, a plurality of driving teeth 470, a central hole (not labeled) and two protrusions 491, 492. The central hole is located at a center of the annular body 440, and the guiding portions 430 have bevel gear structures protruding outward from the annular body 440 and are used for coupling to the knob 500. The two retaining portions 410, 420 protrude inwardly from the annular body 440 and are disposed symmetrically to each other. Each of the retaining portions 410, 420 includes a free end 411, 421. The free ends 411, 421 can move in the radial direction after being forced by an external force, and can be restored after the external force is removed. The two protrusions 491, 492 protrude inwardly from the annular body 440, and an interval is contained between each of the two protrusions 491, 492 and each of the two free ends 411, 421. The driving teeth 470 are located at a bottom side of the annular body 440 and can be selectively engaged with the engaging teeth 320 of the spool 300.

Each of the pawl arms 450 is selectively engaged with at least one of the mounting teeth 230, and each of the pawl arms 450 includes a distal end 452 and a proximal end 451. The proximal end 451 is connected to an outside of the annular body 440, and the distal end 452 is configured to detachably engage with the mounting teeth 230. Each of the three engaging portions 460 is located on each of the pawl arms 450 and protrudes radially outward, and the engaging portions 460 are configured as single-tooth structures. Moreover, the pawl arm 450 has a first height $H_1$, the engaging portion 460 has a second height $H_2$, and a relationship of $H_2 \leq (H_1/2)$ is satisfied. Furthermore, the pawl arm 450 has a height central line L1, and the engaging portion 460 is lower than or flush with the height central line L1. In the embodiment of FIG. 4, the engaging portion 460 is lower than the height central line L1. It should be noted that the above-mentioned first height $H_1$ represents the maximum height of the pawl arm 450 along the axial direction I1. Therefore, if the height of each portion of the pawl arm 450 is different, the maximum height is taken as the first height $H_1$.

As shown in FIG. 4 and FIG. 6, the engaging unit 400 is in the first position, the driving teeth 470 of the engaging unit 400 are engaged with the engaging teeth 320 of the spool 300, when the above-mentioned condition is satisfied, the distal end 452 of the pawl arm 450 (shown in FIG. 2) is engaged with the mounting teeth 230 in the first direction A1 (shown in FIG. 2), the distal end 452 of the pawl arm 450 is continuously disengaged with the mounting teeth 230 in a second direction A2 (shown in FIG. 2), and the engaging portion 460 are not engaged with the mounting teeth 230 owing to that its position is relatively lower than the mounting teeth 230. Therefore, rotating the knob 500 in the second direction A2 can drive the engaging unit 400 to actuate the spool 300 to retract the lace, and when the knob 500 is immobile, the distal end 452 of the pawl arm 450 abuts against the mounting teeth 230 to prevent the spool 300 from rotating toward the first direction A1, thereby preventing the lace from being released.

Furthermore, rotating the knob 500 in the first direction A1 allows the engaging unit 400 to be raised along the axial direction I1, such that the engaging unit 400 is disengaged from the spool 300. Precisely, when the engaging unit 400 is in the first position, the guiding portion 430 is engaged with the guiding track 510 of the knob 500, as shown in FIG. 8, one of the positioning blocks 540 is located between the free end 411 of the retaining portion 410 and the protrusion 491, and the other one of the positioning blocks 540 is located between the free end 421 of the retaining portion 420 and the protrusion 492. When the knob 500 is rotated in a first direction A1, the engaging unit 400 is unable to be rotated simultaneously owing to the engaging relationship between the pawl arm 450 and the mounting teeth 230. Therefore, the two positioning blocks 540 respectively press against the two free ends 411, 421, and the two free ends 411, 421 are deformed in the radial direction so that the knob 500 is able to be rotated relative to the engaging unit 400. The guiding portion 430 is guided by the guiding track 510 to be raised in the axial direction I1 relative to the guiding track 510, and the engaging unit 400 is switched to the second position. Meanwhile, one of the aforementioned positioning blocks 540 is changed to be located between the free end 411 of the retaining portion 410 and the protrusion 492, and the aforementioned other one of the positioning blocks 540 is changed to be located between the free end 421 of the retaining portion 420 and the protrusion 491.

As shown in FIG. 5, since the engaging unit 400 is in the second position, the driving teeth 470 of the engaging unit 400 are disengaged with the engaging teeth 320 of the spool 300. Meanwhile, the spool 300 is not affected by the engaging unit 400, and can be rotated in the first direction A1 (shown in FIG. 2), such that the lace can be released by pulling the lace itself.

As shown in FIG. 7, after the engaging unit 400 is raised along the axial direction I1, the relative position between the engaging portion 460 and the mounting teeth 230 is changed, and the engaging portion 460 is engaged with the mounting teeth 230. If a user would like to secure or retract the lace again, the knob 500 can be rotated in the second direction A2, the two positioning blocks 540 press against the two free ends 411, 421, respectively, and the two free ends 411, 421 are deformed in the radial direction such that the knob 500 can be rotated relative to the engaging unit 400, thereby allowing the aforementioned one of the positioning blocks 540 to return to the place between the free end 411 of the retaining portion 410 and the protrusion 491, and allowing the aforementioned other one of the positioning blocks 540 to return to the place between the free end 421 of the retaining portion 420 and the protrusion 492.

Generally, when the same force is applied, the ability of the pawl arm 450 to deform in the radial direction after being stressed is less than the ability of the retaining portions 410, 420 to deform in the radial direction after being stressed. Therefore, when the knob 500 is rotated in the second direction A2, the pawl arm 450 is not easily deformed and the friction force between the pawl arm 450 and the mounting teeth 230 will be greater than the pressure that the retaining portions 410, 420 can withstand, thereby preventing the engaging unit 400 from rotating with the knob 500. Therefore, the two free ends 411, 421 of the two retaining portions 410, 420 can be pressed and deformed in the radial direction, thereby achieving the purpose of switching positions of the engaging unit 400.

However, since the pawl arm 450 of the engaging unit 400 has been bent for a long time, the shaped thereof is easy to be fixed. Therefore, when the engaging unit 400 is in the second position, and the user would like to rotate the knob 500 in the second direction A2 to switch the engaging unit 400 to return to the first position, without the assistance from the engaging portion 460, the friction force between the pawl arm 450 and the mounting teeth 230 will be insufficient owing to the fixed shape. When the knob 500 is rotated in the second direction A2 and the pawl arm 450 is continuously disengaged from the mounting teeth 230, the two free ends 411, 421 cannot be deformed by pressing of the two positioning blocks 540, which leads to a situation that the engaging unit 400 cannot be switched.

When the engaging portion 460 is provided, because the engaging portion 460 will engage with the mounting teeth 230, rotating the knob 500 in the second direction A2 cannot make the pawl arm 450 be disengaged from the mounting teeth 230, and the two positioning blocks 540 are able to force on the two free ends 411, 421 to cause deformation, thereby achieving the purpose of switching positions.

Moreover, a first distance $D_1$ is contained between the proximal end 451 and the distal end 452, a second distance $D_2$ is contained between the engaging portion 460 and the proximal end 451, and the relationship of $D_2 \leq (2D_1/3)$ is satisfied. Furthermore, the first distance $D_1$ and the second distance $D_2$ satisfy the relationship of $D_2=(D_1/2)$. When the pawl arm 450 is engaged with the mounting teeth 230, the deformation of the proximal end 451 is less than the deformation of the distal end 452. Therefore, under long-term operation, the influence caused by the fixed shape is also smaller. When the configuration of the engaging portions 460 conforms to the above-mentioned relationship, the stability of the structure will be increased. In other embodiments, the engaging portions can also be disposed on the annular body and located below the guiding portions, and the present disclosure is not limited thereto.

It should be particularly noted that, in the embodiment shown in FIGS. 1 to 7, although the distal end 452 of the pawl arm 450 is still engaged with the mounting teeth 230 when the engaging unit 400 is in the second position. In other embodiments, when the engaging unit is in the second position, the distal end of the pawl arm can be completely disengaged from the mounting teeth and only the engaging portion is engaged with the mounting teeth, and it is not limited to the above disclosure.

In other embodiments, the mounting teeth can also be located on the knob. In other words, one of the knob and the case unit can include a plurality of mounting teeth, and it is not limited to the disclosure of the drawings.

Figure 9:
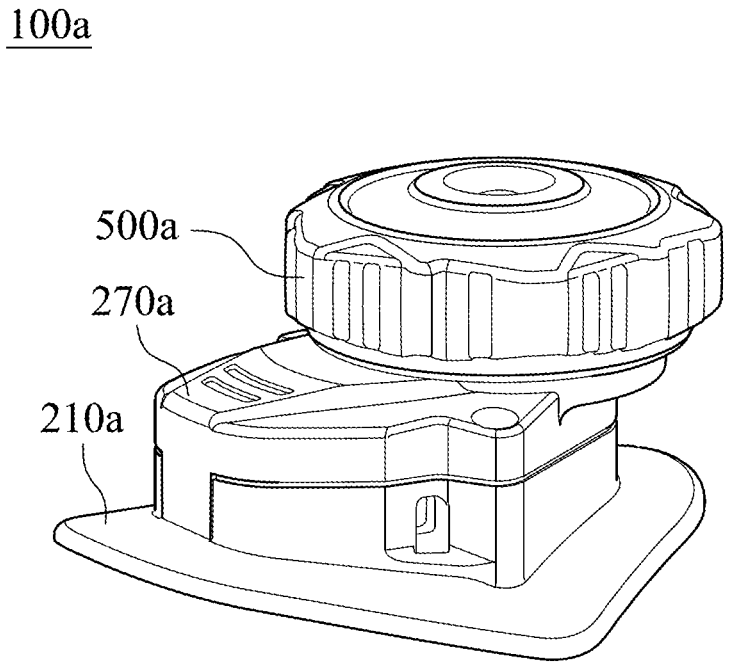
FIG. 9 shows a three dimensional schematic view of a fastening device according to another embodiment of the present disclosure.
Figure 10:
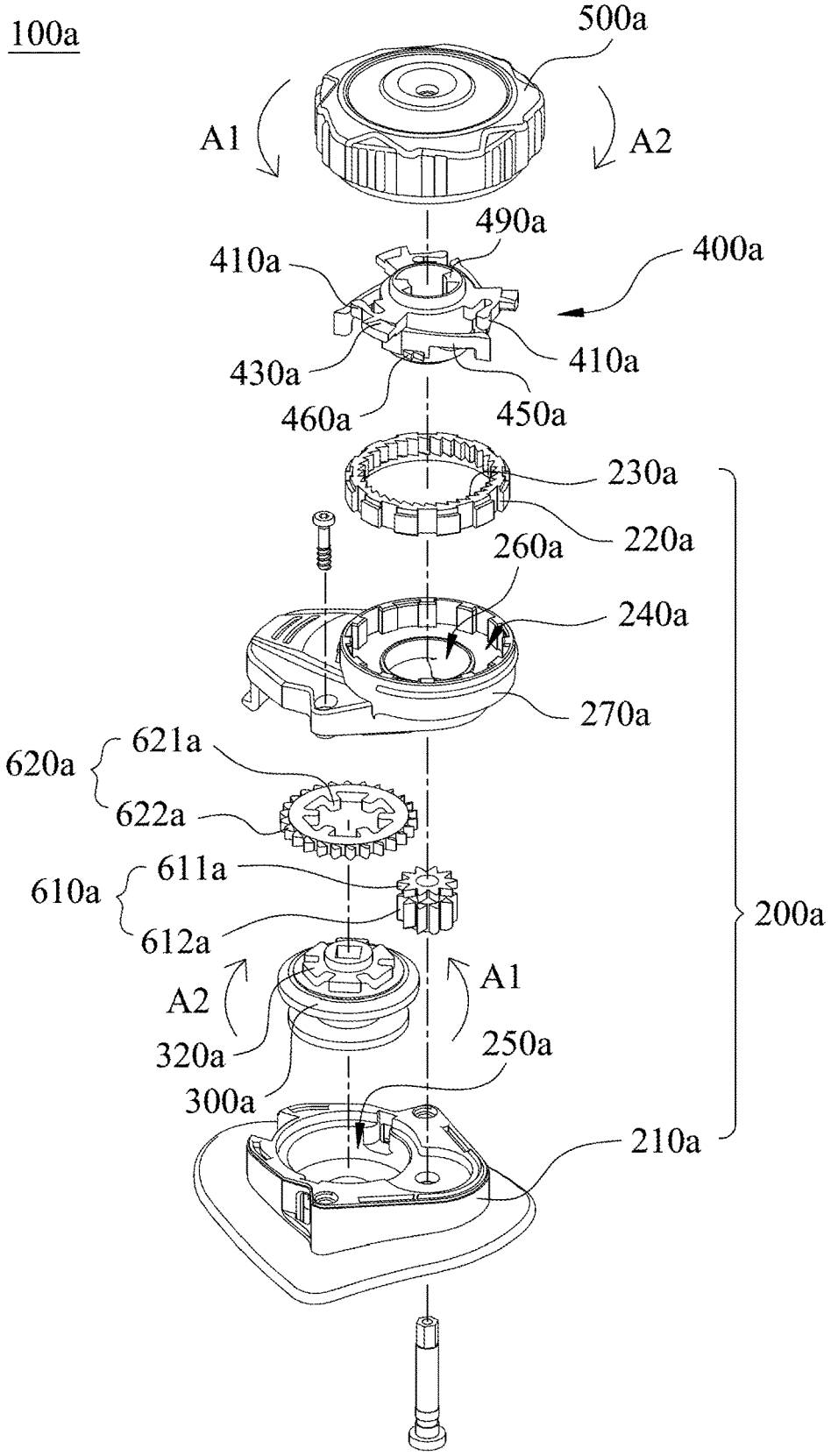
FIG. 10 shows one exploded view of the fastening device of FIG. 9.
Figure 11:
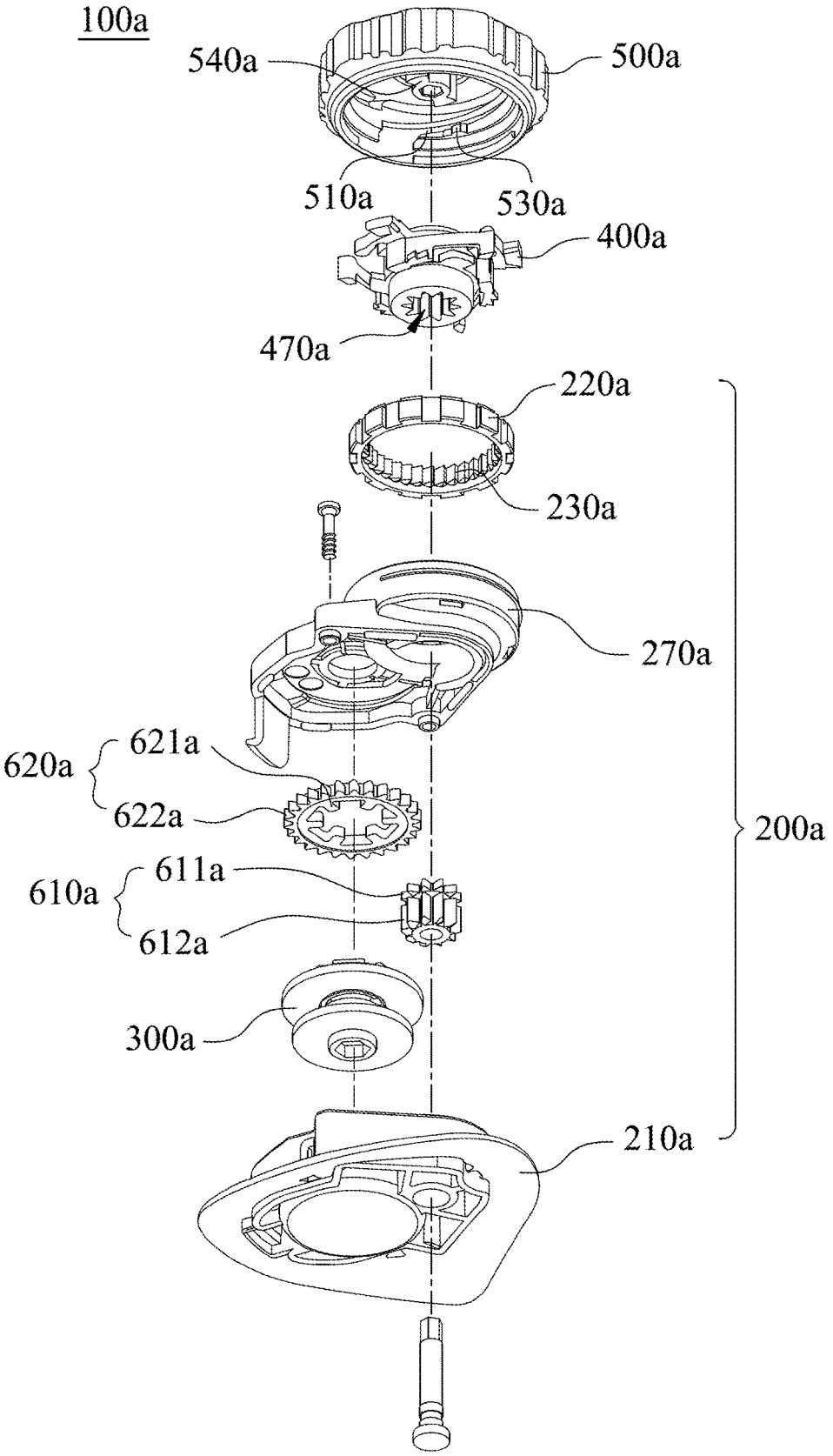
FIG. 11 shows another exploded view of the fastening device of FIG. 9.
Figure 12:
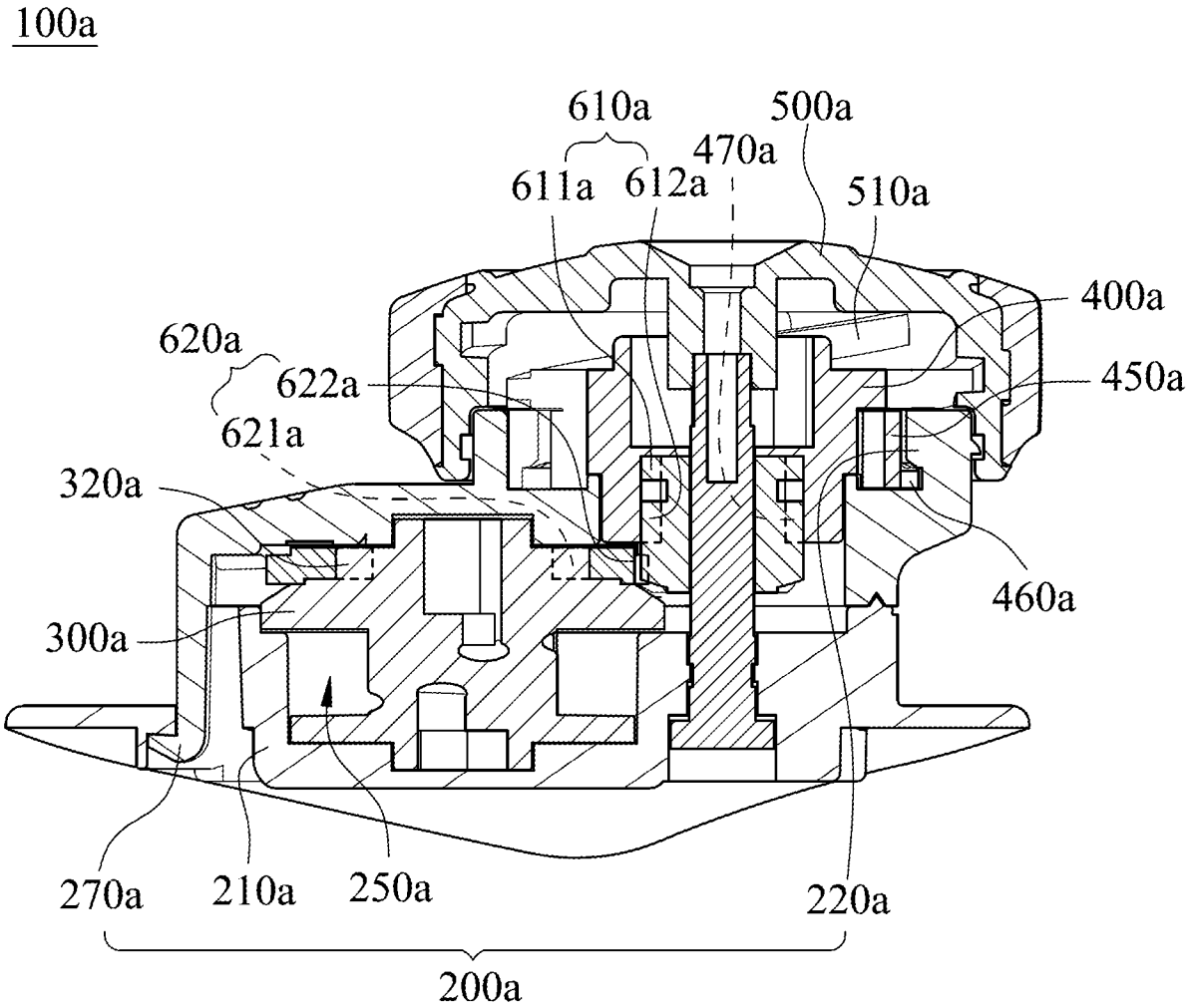
FIG. 12 shows one cross-sectional view of the fastening device of FIG. 9.
Figure 13:
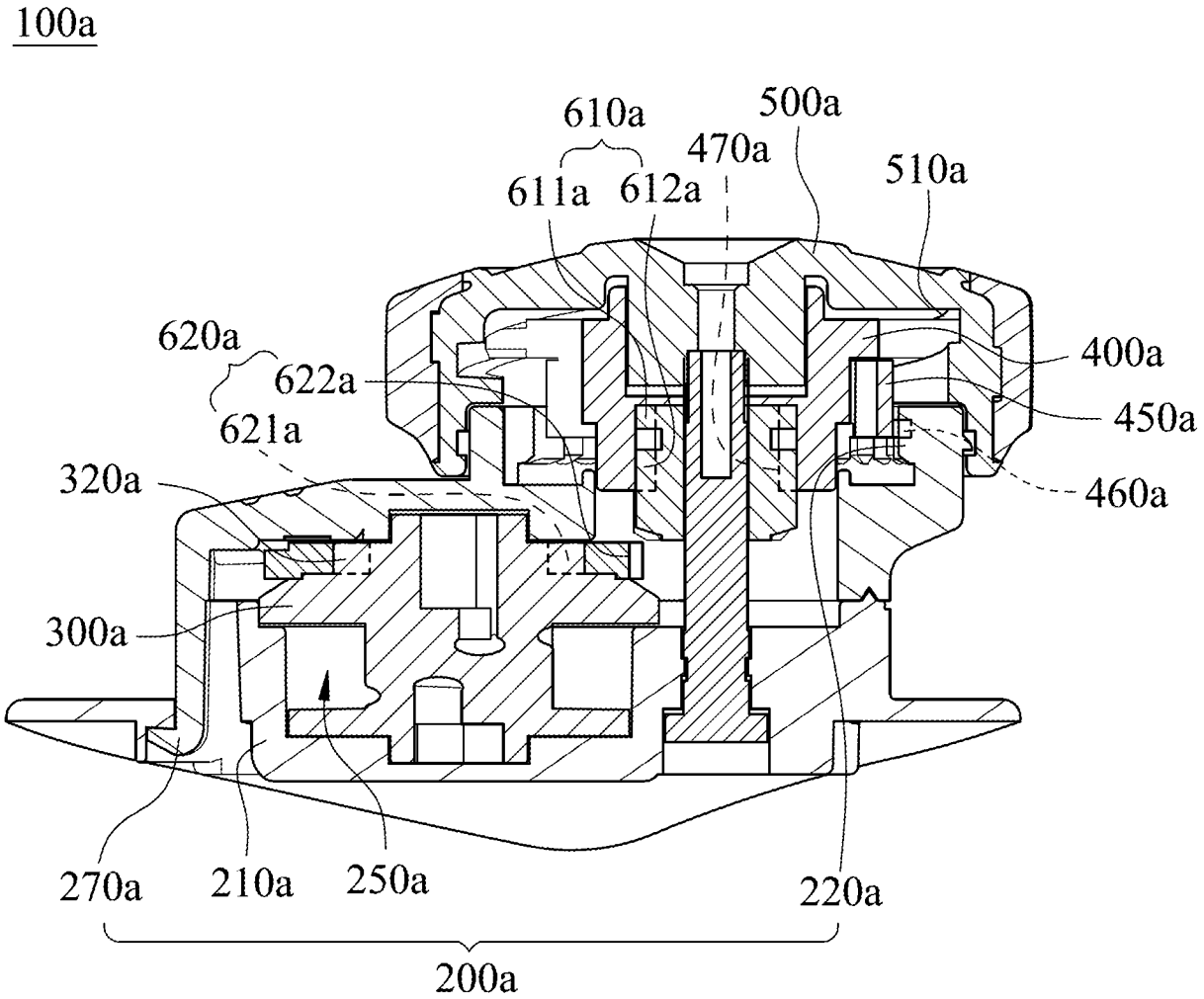
FIG. 13 shows another cross-sectional view of the fastening device of FIG. 9.

Please refer to FIG. 9, FIG. 10, FIG. 11, FIG. 12 and FIG. 13. FIG. 9 shows a three dimensional schematic view of a fastening device 100*a* according to another embodiment of the present disclosure. FIG. 10 shows one exploded view of the fastening device 100*a* of FIG. 9. FIG. 11 shows another exploded view of the fastening device 100*a* of FIG. 9. FIG. 12 shows one cross-sectional view of the fastening device 100*a* of FIG. 9. FIG. 13 shows another cross-sectional view of the fastening device 100*a* of FIG. 9. The fastening device 100*a* includes a case unit 200*a*, a knob 500*a*, an engaging unit 400*a*, and a spool 300*a*. The operation of the fastening device 100*a* is similar to that of the fastening device 100 in FIG. 1, and will be described as follows.

The case unit 200*a* includes an annular wall 220*a*, a case 270*a*, a base 210*a*, a spool space 250*a*, an inner space 240*a*, a communicating space 260*a* and a plurality of mounting teeth 230*a*. The spool space 250*a* is located on the base 210*a*, the case 270*a* covers on the base 210*a* to close the spool space 250*a*, the inner space 240*a* is located in the case 270*a*, and the communicating space 260*a* is also located in the case 270*a*, located at a lower side of the inner space 240*a*, and communicates with the inner space 240*a*. The annular wall 220*a* is located in the inner space 240*a*, and the mounting teeth 230*a* are disposed on the annular wall 220*a* and face toward the inner space 240*a*.

The engaging unit 400*a* includes an annular body (not labeled), two driving blocks 490*a*, three guiding portions 430*a*, three retaining portions 410*a*, three pawl arms 450*a*, three engaging portions 460*a* and a plurality of driving teeth 470*a*. The three guiding portions 430*a*, the three retaining portions 410*a* and the three pawl arms 450*a* are protrudingly disposed on an outside of the annular body, the two driving blocks 490*a* are protrudingly disposed on an inside of the annular body, the three engaging portions 460*a* are respectively located on the three pawl arms 450*a*, and the engaging portions 460*a* include double-teeth structures, which facilitates increasing the stability of the structure.

The knob 500*a* includes a post (not shown), a guiding track 510*a*, two positioning blocks 540*a* and three pushing blocks 530*a*. The guiding track 510*a* and the three pushing blocks 530*a* are disposed on an inner wall of the knob 500*a*. The relationship between the post and the two positioning blocks 540*a* is similar to the structural relationship of the post 520 and the two positioning blocks 540 in FIG. 3.

When the knob 500*a* is rotated toward the first direction A1, each of the pushing blocks 530*a* presses and deforms each of the retaining portions 410*a*, thereby allowing the knob 500*a* to rotate relative to the engaging unit 400*a*, the guiding portion 430*a* is guided by the guiding track 510*a* and raised relative to the guiding track 510*a* along the axial direction, and the engaging unit 400*a* is switched to the second position. On the contrary, when the knob 500*a* is rotated toward the second direction A2, each of the pushing blocks 530*a* presses and deforms each of the retaining portions 410*a*, thereby allowing the knob 500*a* to rotate relative to the engaging unit 400*a*, the guiding portion 430*a* is guided by the guiding track 510*a* and descended relative to the guiding track 510*a* along the axial direction, and the engaging unit 400*a* is switched to the first position.

The fastening device 100*a* further includes a first transmission gear 610*a* and a second transmission gear 620*a*. The first transmission gear 610*a* includes upper teeth 611*a* and lower teeth 612*a*, and the second transmission gear 620*a* includes external teeth 622*a* and internal teeth 621*a*.

The spool 300*a* is accommodated in the spool space 250*a* and includes engaging teeth 320*a*, the second transmission gear 620*a* is disposed above the spool 300*a*, and the internal teeth 621*a* are engaged with the engaging teeth 320*a*. The first transmission gear 610*a* is disposed in the communicating space 260*a*, the engaging unit 400*a* is disposed in the inner space 240*a*, the upper teeth 611*a* of the first transmission gear 610*a* are engaged with the driving teeth 470*a* of the engaging unit 400*a*, and the lower teeth 612*a* of the first transmission gear 610*a* are detachably engaged with the external teeth 622*a* of the second transmission gear 620*a*.

As shown in FIG. 12, the engaging unit 400*a* is in the first position, the lower teeth 612*a* of the first transmission gear 610*a* are engaged with the second transmission gear 620*a*, and as the condition of the above-mentioned situations are satisfied, the distal end (not labeled) of the pawl arm 450*a* is engaged with the mounting teeth 230*a* in the first direction A1 while the distal end of the pawl arm 450*a* is continuously disengaged from the mounting teeth 230*a* in the second direction A2, and the engaging portion 460*a* is not engaged with the mounting teeth 230*a* owing to its position being relative lower than the mounting teeth 230*a*. Therefore, rotating the knob 500*a* in the second direction A2 can drive the engaging unit 400*a* to rotate the spool 300*a* in the first direction A1 to retract the lace, and when the knob 500*a* is immobile, the distal end of the pawl arm 450*a* abuts against the mounting teeth 230*a*, thereby preventing the spool 300*a* from rotating and preventing the lace from being released.

Rotating the knob 500*a* allows the guiding portion 430*a* to be raised along the guiding track 510*a*, and the engaging unit 400*a* is switched from the first position to the second position. Therefore, as shown in FIG. 13, the first transmission gear 610*a* is lifted with the engaging unit 400*a*, and the lower teeth 612*a* of the first transmission gear 610*a* is disengaged from the second transmission gear 620*a*. Meanwhile, the spool 300*a* is not affected by the engaging unit 400*a* and can be rotated in the second direction A2, and the lace is able to be released by pulling the lace itself. Consequently, as the engaging unit 400*a* is raised along the axial direction, the relative position between the engaging portion 460*a* and the mounting teeth 230*a* is changed, thereby allowing the engaging portion 460*a* to engage with the mounting teeth 230*a*.

Although the present disclosure has been described in considerable detail with reference to certain embodiments thereof, other embodiments are possible. Therefore, the spirit and scope of the appended claims should not be limited to the description of the embodiments contained herein. It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A fastening device, comprising:

a case unit, having an axial direction and comprising a plurality of mounting teeth;

a knob, covered on the case unit along the axial direction;

an engaging unit, coupled to the knob and comprising an engaging portion; and a spool, configured for a lace to wind therearound;

wherein the engaging unit is driven by the knob to switch between a first position and a second position along the axial direction, when the engaging unit is in the first position, the engaging unit prohibits the spool from releasing the lace, and when the engaging unit is in the second position, the engaging portion is engaged with at least one of the mounting teeth, and the engaging unit does not prohibit the spool from releasing the lace.

2. The fastening device of claim 1, wherein the engaging unit further comprises a pawl arm selectively engaged with at least one of the mounting teeth, and the engaging portion is disposed on the pawl arm and protrudes outward along a radial direction of the case unit.

3. The fastening device of claim 2, wherein the pawl arm has a first height $H_1$, the engaging portion has a second height $H_2$, and a relationship of $H_2 \leq (H_1/2)$ is satisfied.

4. The fastening device of claim 2, wherein the pawl arm has a height central line, and the engaging portion is lower than or flush with the height central line.

5. The fastening device of claim 2, wherein the engaging unit further comprises an annular body, the pawl arm has a proximal end and a distal end, the proximal end is connected the annular body, a first distance $D_1$ is contained between the proximal end and the distal end, a second distance $D_2$ is contained between the engaging portion and the proximal end, and a relationship of $D_2 \leq (2D_1/3)$ is satisfied.

6. The fastening device of claim 5, wherein the first distance $D_1$ and the second distance $D_2$ satisfy a relationship of $D_2=(D_1/2)$.

7. A fastening device, comprising:

a case unit, having an axial direction;

a knob, covered on the case unit along the axial direction;

an engaging unit, coupled to the knob and comprising an engaging portion; and a spool, configured for a lace to wind therearound;

wherein one of the knob and the case unit comprises a plurality of mounting teeth, the engaging unit is driven by the knob to switch between a first position and a second position along the axial direction, when the engaging unit is in the first position, the engaging unit prohibits the spool from releasing the lace, and when the engaging unit is in the second position, the engaging portion is engaged with at least one of the mounting teeth, and the engaging unit does not prohibit the spool from releasing the lace.

8. The fastening device of claim 7, wherein the engaging unit further comprises a pawl arm selectively engaged with at least one of the mounting teeth, and the engaging portion is disposed on the pawl arm and protrudes outward along a radial direction of the case unit.

9. The fastening device of claim 8, wherein the pawl arm has a first height $H_1$, the engaging portion has a second height $H_2$, and a relationship of $H_2 \leq (H_1/2)$ is satisfied.

10. The fastening device of claim 9, wherein the pawl arm has a height central line, and the engaging portion is lower than or flush with the height central line.

11. The fastening device of claim 10, wherein the engaging unit further comprises an annular body, the pawl arm has a proximal end and a distal end, the proximal end is connected the annular body, a first distance $D_1$ is contained between the proximal end and the distal end, a second distance $D_2$ is contained between the engaging portion and the proximal end, and a relationship of $D_2 \leq (2D_1/3)$ is satisfied.

12. The fastening device of claim 11, wherein the first distance $D_1$ and the second distance $D_2$ satisfy a relationship of $D_2=(D_1/2)$.

* * * * *